US008508358B2

(12) United States Patent
Seo et al.

(10) Patent No.: US 8,508,358 B2
(45) Date of Patent: Aug. 13, 2013

(54) APPARATUS AND METHOD FOR CONTROLLING ALARM IN A PORTABLE TERMINAL

(75) Inventors: Seok-Weon Seo, Suwon-si (KR); Nam-Hoon Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 772 days.

(21) Appl. No.: 12/587,028

(22) Filed: Sep. 30, 2009

(65) Prior Publication Data

US 2010/0079275 A1 Apr. 1, 2010

(30) Foreign Application Priority Data

Sep. 30, 2008 (KR) ..... 10-2008-0095864

(51) Int. Cl.
*G08B 1/08* (2006.01)

(52) U.S. Cl.
USPC ..... 340/539.11; 340/539.16; 340/4.37; 340/6.1; 340/7.1; 340/12.5; 340/309.7; 340/309.16; 340/407.1; 340/575; 340/603; 340/692; 368/10; 368/13; 368/73

(58) Field of Classification Search
USPC ..... 340/539.11, 539.16, 4.37, 6.1, 7.1, 340/12.5, 309.7, 309.16, 407.1, 575, 603, 340/692; 368/10, 13, 73
See application file for complete search history.

(56) References Cited

U.S. PATENT DOCUMENTS

2006/0135220 A1* 6/2006 Kim et al. ..... 455/573
2007/0268784 A1* 11/2007 Xu ..... 368/73

* cited by examiner

*Primary Examiner* — Tai T Nguyen

(57) ABSTRACT

A portable terminal includes an alarm control. A method for controlling an alarm includes determining whether an input fact to analyze an exceptional situation of an alarm operation is generated; analyzing the exceptional situation by rule using at least one fact; and when there is an alarm which is placed in the exceptional situation, cancelling the alarm.

17 Claims, 3 Drawing Sheets

APPARATUS AND METHOD FOR CONTROLLING ALARM IN A PORTABLE TERMINAL

CROSS-REFERENCE TO RELATED APPLICATION(S) AND CLAIM OF PRIORITY

The present application is related to and claims the benefit under 35 U.S.C. §119(a) to a Korean patent application filed in the Korean Intellectual Property Office on Sep. 30, 2008 and assigned Serial No. 10-2008-0095864, the entire disclosure of which is hereby incorporated by reference.

TECHNICAL FIELD OF THE INVENTION

The present invention relates generally to a portable terminal. More particularly, the present invention relates to an apparatus and a method for controlling an alarm operation of the portable terminal.

BACKGROUND OF THE INVENTION

In the modern society, the use of portable terminals is greatly increasing thanks to their convenience and necessity. Now, the portable terminal has become a necessity. To further elevate the utilization of the portable terminal, service providers and terminal manufacturers offer a great number of additional functions. For example, the portable terminal includes phone book, game, scheduler, short message service, multimedia message service, cell broadcasting service, Internet service, e-mail, morning call, alarm, MP3 play, and digital camera functions.

Among the functions of the portable terminals, a morning call and alarm functions were used as an alarm clock. Recently, as almost everybody possesses his/her own portable terminal, the morning call and alarm functions of the portable terminal are more frequently used than the alarm function of the alarm clock. When using the general morning call and alarm functions of the portable terminal, a user sets his/her intended alarm time and an intended period of the alarm. Typically, the period is selected to one of the options provided by the portable terminal and can be set to one time, every day, or a specific day.

In order to not ring the alarm at a specific day within the set period, the user needs to change the alarm setting personally. For example, when the alarm is set to ring from Monday to Friday and a particular Monday is a day off or a vacation, the user may not want the alarm on the particular Monday. In this case, the user needs to change the alarm setting personally. Additionally, to ring the alarm again on the next Monday, the user has to modify the setting after the particular Monday. In other words, the portable terminal cannot perform the exception handling with respect to the alarm operation. Therefore, what is needed is a method for addressing the inconvenience of the user in the alarm function.

SUMMARY OF THE INVENTION

To address the above-discussed deficiencies of the prior art, it is a primary aspect of the present invention to provide an apparatus and a method for exception handling in an alarm operation of a portable terminal.

Another aspect of the present invention is to provide an apparatus and a method for controlling an alarm according to a defined rule in a portable terminal.

Yet another aspect of the present invention is to provide an apparatus and a method for determining a rule to control an alarm in a portable terminal.

According to one aspect of the present invention, a method for controlling an alarm in a portable terminal includes determining whether an input fact to analyze an exceptional situation of an alarm operation is generated; analyzing the exceptional situation by rule using at least one fact; and when there is an alarm which is placed in the exceptional situation, cancelling the alarm.

According to another aspect of the present invention, an apparatus for a portable terminal includes a rule engine that, when an input fact is generated to analyze an exceptional situation of an alarm operation, analyzes the exceptional situation by rule using at least one fact; and an alarm manager for, when there is an alarm which is placed in the exceptional situation, cancelling the alarm.

Other aspects, advantages, and salient features of the invention will become apparent to those skilled in the art from the following detailed description, which, taken in conjunction with the annexed drawings, discloses exemplary embodiments of the invention.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

Throughout the drawings, like reference numerals will be understood to refer to like parts, components and structures.

DETAILED DESCRIPTION OF THE INVENTION

Figure 1:
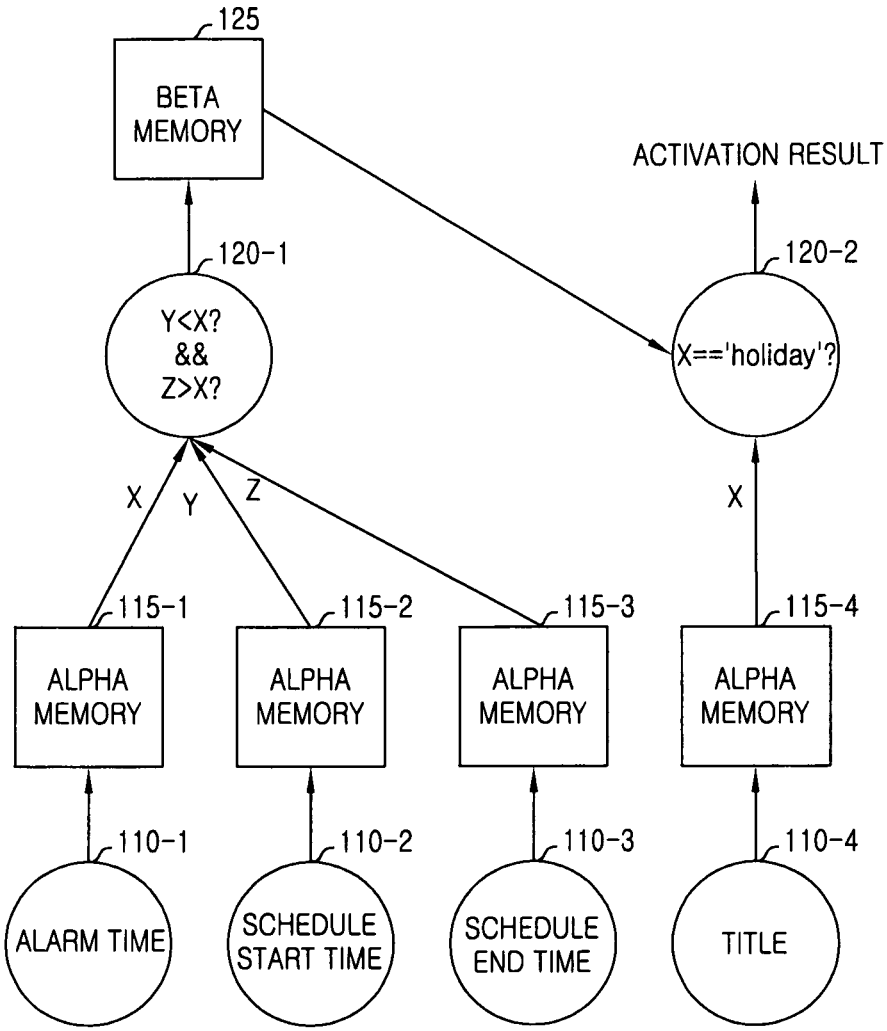
FIG. 1 illustrates a diagram of a rete network for exceptional situation analysis in a portable terminal according to an exemplary embodiment of the present invention.
Figure 2:
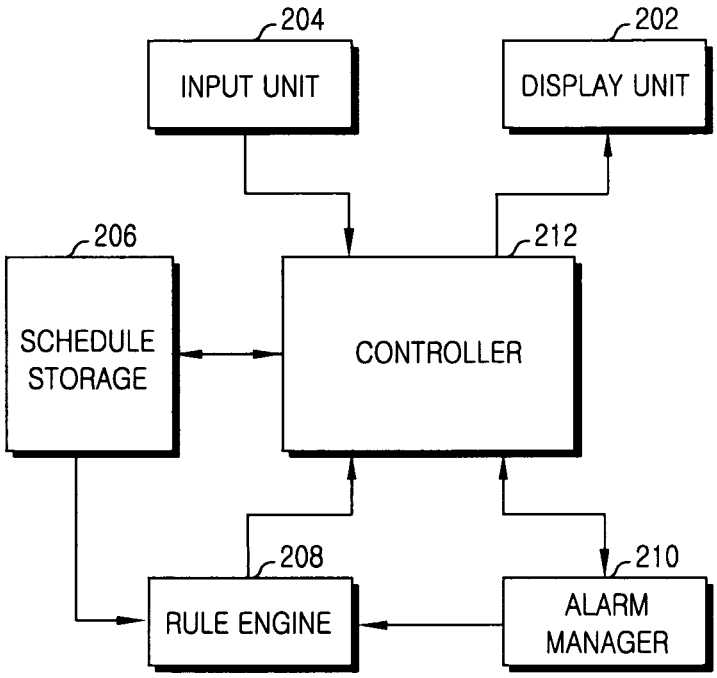
FIG. 2 illustrates a block diagram of the portable terminal according to an exemplary embodiment of the present invention.
Figure 3:
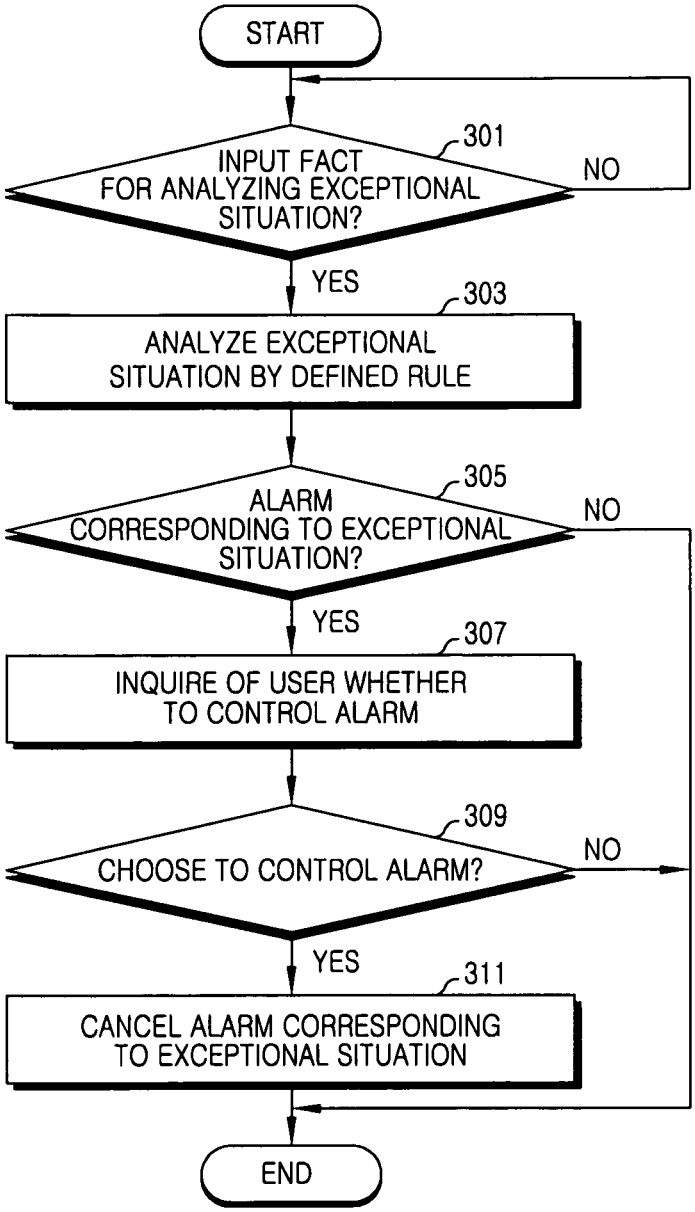
FIG. 3 illustrates a flowchart of an alarm control method of the portable terminal according to an exemplary embodiment of the present invention.

FIGS. 1 through 3, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged portable terminal.

Exemplary embodiments of the present invention provide a technique for exception handling in an alarm operation of a portable terminal. Hereinafter, the portable terminals cover cellular phones, Personal Communication Systems (PCSs), Personal Digital Assistants (PDAs), and International Mobile Telecommunication (IMT) 2000 terminals.

Prior to the exception handling of the alarm operation, the portable terminal needs to analyze the exceptional situation. To analyze the exceptional situation, the portable terminal can use schedule information or calendar information of a user. That is, the portable terminal analyzes the exceptional situation using the schedule information or the calendar information of the user input through a scheduler function of the portable terminal.

A rule engine of the portable terminal analyzes the exceptional situation. The rule engine can use facts constituting the schedule information, the calendar information, and alarm information as its input parameters and analyzes the exception according to a predefined rule. For example, when the schedule information, such as, for example, a vacation, travel, and conference, has been stored, date, time, title, and place are used as the facts. As for the calendar information, the date of a regular holiday can be used as the fact. Namely, the rule engine extracts the facts from the schedule information, the calendar information, and the alarm information and analyzes the exceptional situation of the currently registered alarm according to the predefined rule.

The rule for the exception analysis can vary in form. In this exemplary embodiment of the present invention, the rule can be a set of simple conditions. For example, the conditions can include 'If it is a regular holiday, the alarm does not ring.' and 'If on the trip, the alarm does not ring.' Alternatively, the rule can be implemented using a rete algorithm. The rete algorithm allows the fast analysis because it stores the rules in the rete network and evaluates only the changed facts. When the facts are input to the lowest nodes of the rete network, intermediate nodes evaluate the facts by rule and highest nodes determine whether to control the alarm by aggregating the analysis results.

For example, it is assumed that the rule of Table 1 is applied.

TABLE 1

```
If
    (Title == holiday)
        && (Schedule_StartTime < Alarma_Time)
        && (Schedule_EndTime > Alarma_Time)
then
    Publish (Alarm Control)
```

The rule of Table 1 is written in an Extensible Markup Language (XML) in advance and registered to the rule engine. Next, the facts input to the rule engine are stored to the lowest node, passed through the evaluation through the rule matching by degrees, and are activated at the highest node. When the activation result is true, the rule engine forwards the result to an alarm manger which controls the alarm. The rule of Table 1 can be expressed in the XML as shown in Table 2.

TABLE 2

```
<rule id="RULE_02">
<antecedent>
<context id="CID_ALARM_INFO">
<slot id="hAlarm"><val>?handle</val></slot>
<slot id="alarmSet"><val>1</val></slot>
<slot id="alarmTime"><val>?alarmtime</val></slot>
<slot id="alarmRepeatType"><val>?repeattime</val></slot>
</context>
<context id="CID_SCHEDULE_INFO">
<slot id="szSummary">
<val>?summary</val>
<tester>
<eq><var type="string">?summary</var><var type=\"string\">holiday
</var></eq>
</tester>
</slot>
<slot id="startTime">
<val>?sTime</val>
<tester>
<lt><var type="int">?sTime</var><var type="int">?alarmtime</var></lt>
</tester>
</slot>
<slot id="endTime">
<val>?eTime</val></slot>
<tester>
<gt><var type="int">?eTime</var><var type="int">?alarmtime</var>
</gt>
</tester>
</context>
</antecedent>
<consequent>
<action id="publish">
<context id="CID_AUTO_ALARM_FILTER">
<slot id="hAlarm"><val>?handle</val</slot>
<slot id="alarmTime"><val>?alarmtime</val></slot>
<slot id="alarmRepeatType"><val>?repeattime</val></slot>
</context>
</action>
</consequent>
</rule>
```

The rule of Table 1 and Table 2 is expressed as the rete network in FIG. 1. The facts necessary for the rule of Table 1 and Table 2 include an alarm time, a schedule start time, a schedule end time, and a title. Accordingly, the lowest nodes 110-1 through 110-4 of the rete network store the facts to alpha memories 115-1 through 115-4 in a form usable in the rete network. The intermediate nodes 120-1 through 120-2 evaluate the facts according to the conditions of the rule. For example, the first intermediate node 120-1 concurrently determines whether the fact X is greater than the fact Y and whether the fact X is smaller than the fact Z. The first intermediate node 120-1 stores the evaluation result to a beta memory 125. The evaluation result stored to the beta memory 125 is provided to the second intermediate node 120-2. When the evaluation result is true, the second intermediate node 120-2 performs the evaluation. That is, the second intermediate node 120-2 checks whether the fact X is 'holiday'. The evaluation result of the second intermediate node 120-2 is output as the activation result.

The structure of the rete network in FIG. 1 is an example of the rete network structure in relation to the rule of Table 1. Naturally, when the rule changes, the structure of the rete network also changes; that is, the number and the type of the input facts or the connections of the intermediate nodes alter. Additionally, a rete network structure different from FIG. 1 can be configured with respect to the rule of Table. 1.

The aforementioned exceptional situation is analyzed when the facts required for the analysis are generated. More specifically, when a new alarm is registered or when a new schedule is input, the analysis is conducted on the exceptional situation. The portable terminal can query the user whether to control the alarm in the analyzed exceptional situation. For example, the portable terminal displays a screen requesting the user's selection using a pop-up window. The user's selection request, using the pop-up window, can additionally display at least one of the schedule information and the alarm information. When the user selects the alarm control, the portable terminal cancels the alarm corresponding to the exceptional situation.

The rule applied to the exceptional situation analysis can be added, deleted, and updated through the input of the portable terminal from the outside. For example, when the rule of Table 2 is written using the XML, the portable terminal can receive and add the rule written in the XML from the outside. Additionally, the user can create his/her intended rule at will and build its optimized alarm control rule by inputting the created rule to the portable terminal.

Now, the structure and the operations of the portable terminal for controlling the alarm as stated above are described in detail by referring to the drawings.

FIG. 2 illustrates a block diagram of the portable terminal according to an exemplary embodiment of the present invention.

The portable terminal of FIG. 2 includes a display unit 202, an input unit 204, a schedule storage 206, a rule engine 208, an alarm manager 210, and a controller 212.

The display unit 202 displays visual information. More particularly, under the control of the controller 212, the display unit 202 can display status, numbers, characters, images and videos of the portable terminal in the visual forms viewable to the user. For example, the display unit 202 can be implemented using one of a Cathode-Ray Tube (CRT), a Liquid Crystal Display (LCD), and an Organic Light-Emitting Diode (OLED). The input unit 204 includes a means for recognizing the user's input. The input unit 204 can provide information, generated according to the user's input, to the controller 212. For example, the input unit 204 includes at least one input means of a keypad, a touch pad, and a microphone.

The schedule storage 206 can store the schedule information input through the scheduler function. When the schedule is added or updated, the schedule storage 206 can provide the added or updated schedule information to the rule engine 208. For example, when the schedule titled "a day off in a specific period" is added through the scheduler function, the schedule storage 206 informs the rule engine 208 of the start time and the end time of the period and the title.

The rule engine 208 can analyze the exceptional situation with respect to the alarm according to the predefined rule using the fed input facts. The rule engine 208 analyzes the exceptional situation when a new fact is generated, and provides the analysis result to the controller 212. For example, the rule engine 208 analyzes the exceptional situation according to the rule built with the set of the simple conditions, or according to the rule configured as the rete network as illustrated in FIG. 1. The rule configured as the rete network can be written using the XML as shown in Table 2. Under the control of the controller 212, the rule engine 208 can add, delete, or update the rule. For example, when a new rule is fed from the controller 212, the rule engine 208 adds the rule.

The alarm manager 210 can store the alarm schedule input through the alarm setting function. When the alarm time arrives, the alarm manager 210 informs the controller 212 of the arrival of the alarm time. Under the control of the controller 212, the alarm manager 210 cancels the registered alarm. More specifically, when a new alarm is registered, the alarm manager 210 provides the alarm time of the new alarm to the rule engine 208. For example, when the alarm is set to ring at a specific time on a specific day, the alarm manager 210 informs the rule engine 208 of the specific day and the specific time.

The controller 212 can control the functions of the portable terminal. For example, the controller 212 can provide the screen data to be displayed on the display unit 202 to the display unit 202, and can control the operation corresponding to the input data fed from the input unit 204. The controller 212 provides the schedule information input through the scheduler function to the schedule storage 206, and provides the alarm information input through the alarm function to the alarm manager 210.

More specifically, the controller 212 can provide the new rule input from the outside to the rule engine 208. When the exceptional situation is informed from the rule engine 208, the controller 212 executes the function of inquiring about whether to control the alarm corresponding to the exceptional situation. For example, the controller 212 displays the pop-up window, which requests the user to make a selection, through the display unit 202. In so doing, through the pop-up window, the controller 212 can display not only the user's selection request but also at least a portion of the schedule information and the alarm information. Upon confirming the user's selection on the alarm control via the input unit 204, the controller 212 controls the alarm manager 210 to cancel the alarm corresponding to the exceptional situation.

FIG. 3 illustrates a flowchart of an alarm control method of the portable terminal according to an exemplary embodiment of the present invention.

In step 301, the portable terminal determines whether the input fact for the exceptional situation analysis is generated or not. For example, the input fact is generated by the newly registered alarm or the newly input schedule. Namely, the portable terminal determines whether the alarm is newly registered or the schedule is newly input.

When the input fact generates, the portable terminal analyzes the exceptional situation according to the defined rule using the input fact in step 303. For example, the portable terminal analyzes the exceptional situation according to the rule built with the set of the simple conditions, or according to the rule configured as the rete network as illustrated in FIG. 1. The rule implemented as the rete network can be written using the XML as shown in Table 2.

In step 305, the portable terminal checks for the alarm corresponding to the exceptional situation. That is, the portable terminal determines whether there is a case where the exceptional situation analysis result is true. When there is no alarm corresponding to the exceptional situation, the portable terminal finishes this process.

When detecting the alarm corresponding to the exceptional situation, the portable terminal queries the user whether to control the alarm in step 307. For example, the portable terminal displays the pop-up window requesting the user's selection. The pop-up window can display not only the user's selection request but also at least one of the schedule information and the alarm information in addition.

In step 309, the portable terminal checks for the user's selection. More specifically, the portable terminal checks whether or not the user chooses to control the alarm. When the user chooses not to control the alarm, the portable terminal finishes this process.

Alternatively, when the user chooses to control the alarm, the portable terminal cancels the alarm corresponding to the exceptional situation in step 311. That is, the portable terminal cancels the alarm corresponding to the exceptional situation not to ring at the set time.

In FIG. 3, the portable terminal analyzes the exceptional situation according to the defined rule. Herein, the rule can be added, deleted, and updated by the input from the outside. Accordingly, when a new rule is input from the outside, the portable terminal adds the new rule (which is not illustrated in FIG. 3).

As the portable terminal controls the registered alarm according to the rule by reflecting the user's intention, the user does not have to reset the alarm in person for the exception handling of the alarm.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method for controlling an alarm in a portable terminal, the method comprising:

determining whether an input fact to analyze an exceptional situation of an alarm operation is generated, wherein the exceptional situation is defined as a status where the alarm does not ring although the alarm is set;

analyzing the exceptional situation by rule using at least one fact; and cancelling at least one alarm setting when the at least one alarm setting is placed in the exceptional situation.

2. The method of claim 1, further comprising:

when the at least one alarm is placed in the exceptional situation, querying a user whether to control the alarm.

3. The method of claim 2, wherein cancelling further comprises cancelling the alarm in response to a selection from the user to control the at least one alarm.

4. The method of claim 2, wherein the step of querying the user whether to control the alarm comprises:

displaying a pop-up window that comprises a request of the user.

5. The method of claim 4, wherein the request comprises at least one of a selection of the user, a schedule information, and an alarm information.

6. The method of claim 1, wherein the rule is implemented as a rete network.

7. The method of claim 6, wherein the rule is defined in a form of an extensible markup language.

8. The method of claim 1, wherein the determining whether the input fact is generated comprises:

determining whether a new schedule input or a new alarm is registered, wherein the input fact comprises at least one of a start time of the schedule, an end time of the schedule, a place of the schedule, a title of the schedule, and an alarm time of the alarm.

9. The method of claim 1, further comprising:

adding a rule when the rule is input from outside of the portable terminal.

10. An apparatus for a portable terminal, the apparatus comprising:

a rule engine configured to analyze an exceptional situation of an alarm operation, when an input fact is generated to analyze the exceptional situation, the rule engine configured to analyze the exception situation by a rule using at least one fact, wherein the exceptional situation is defined as a status where the alarm does not ring although the alarm is set; and an alarm manager configured to cancel at least one alarm setting when the at least one alarm setting is placed in the exceptional situation.

11. The apparatus of claim 10, further comprising:

a controller configured to control a request to control the alarm.

12. The apparatus of claim 11, wherein the alarm manager is configured to cancel the alarm in response to a selection from a user to control the alarm.

13. The apparatus of claim 11, wherein the controller is configured to cause a display to present a pop-up window, the pop-up window comprising at least one of: requesting a selection of the user; schedule information; and alarm information.

14. The apparatus of claim 10, wherein the rule is implemented as a rete network.

15. The apparatus of claim 14, wherein the rule is defined in a form of an extensible markup language.

16. The apparatus of claim 10, wherein the rule engine is configured to determine whether the input fact is generated by checking whether a new schedule input or a new alarm is registered, wherein the input fact comprises at least one of a start time of the schedule, an end time of the schedule, a place of the schedule, a title of the schedule, and an alarm time of the alarm.

17. The apparatus of claim 10, wherein, when a rule is input from outside of the portable terminal, the rule engine adds the rule.

* * * * *